US010967426B2

(12) United States Patent
Fujikawa

(10) Patent No.: US 10,967,426 B2
(45) Date of Patent: Apr. 6, 2021

(54) INJECTION DEVICE OF LIGHT METAL INJECTION MOLDING MACHINE AND INJECTION CONTROL METHOD THEREOF

(71) Applicant: SODICK CO., LTD., Kanagawa (JP)

(72) Inventor: Misao Fujikawa, Kanagawa (JP)

(73) Assignee: Sodick Co., Ltd., Kanagawa (JP)

( * ) Notice: Subject to any disclaimer, the term of this patent is extended or adjusted under 35 U.S.C. 154(b) by 0 days.

(21) Appl. No.: 16/591,639

(22) Filed: Oct. 3, 2019

(65) Prior Publication Data

US 2020/0108439 A1 Apr. 9, 2020

(30) Foreign Application Priority Data

Oct. 5, 2018 (JP) ..... JP2018-189978

(51) Int. Cl.

| | |
|---|---|
| ***B22D 17/32*** | (2006.01) |
| ***B22D 17/10*** | (2006.01) |
| ***B22D 17/20*** | (2006.01) |
| ***B22D 17/30*** | (2006.01) |
| ***B22D 21/04*** | (2006.01) |
| ***B22D 23/06*** | (2006.01) |
| ***B22D 27/00*** | (2006.01) |

(52) U.S. Cl.

CPC ..... *B22D 17/32* (2013.01); *B22D 17/10* (2013.01); *B22D 17/203* (2013.01); *B22D 17/30* (2013.01); *B22D 21/04* (2013.01); *B22D 23/06* (2013.01); *B22D 27/003* (2013.01)

(58) Field of Classification Search

CPC ..... B22D 17/10; B22D 17/20; B22D 17/203; B22D 17/30; B22D 17/32; B22D 21/04; B22D 23/06; B22D 27/00; B22D 27/003

USPC ..... 164/303, 312, 113

See application file for complete search history.

(56) References Cited

U.S. PATENT DOCUMENTS

2016/0200022 A1* 7/2016 Takei et al. ..... B29C 45/82 264/328.1

2018/0117671 A1 5/2018 Fujikawa

FOREIGN PATENT DOCUMENTS

JP 2005199335 7/2005

* cited by examiner

*Primary Examiner* — Kevin P Kerns

(74) *Attorney, Agent, or Firm* — JCIPRNET

(57) ABSTRACT

An injection device of light metal injection molding machine and an injection control method thereof are provided, in which a melt in a supply unit is supplied into an injection unit through a communication passage, a plunger of the injection unit is retracted to measure the melt, the communication passage is closed, and the plunger is advanced to inject the melt into a mold device through an injection nozzle of the injection unit. After the injection and before the measurement, the plunger is advanced under a pressure at which the melt does not come out from the injection nozzle to make the melt in the injection unit flow back into the supply unit through the opened communication passage.

18 Claims, 10 Drawing Sheets

INJECTION DEVICE OF LIGHT METAL INJECTION MOLDING MACHINE AND INJECTION CONTROL METHOD THEREOF

CROSS-REFERENCE TO RELATED APPLICATION

This application claims the priority benefit of Japan application serial No. 2018-189978, filed on Oct. 5, 2018. The entirety of the above-mentioned patent application is hereby incorporated by reference herein and made a part of this specification.

BACKGROUND OF THE DISCLOSURE

Technical Field

The disclosure relates to an injection device of light metal injection molding machine in which a melt of a light metal material in a supply unit is supplied to an injection unit through a communication passage and then the melt in the injection unit is injected into a mold device through an injection nozzle, and relates to an injection control method thereof.

Related Art

The injection device of light metal injection molding machine supplies the melt of the light metal material in the supply unit into the injection unit and injects the melt in the injection unit to the mold. The melt is supplied to the supply unit from outside. The supply unit also includes a melting unit which melts an unmelted light metal material supplied from outside into a melt and supplies the melt into the injection unit.

An injection molding machine in patent literature 1 has a melting device equivalent to the above-described melting unit and an injection portion equivalent to the above-described injection unit. The melting device has a melting cylinder and an inert gas supplying device which supplies an inert gas into the melting cylinder. The injection portion has an injection cylinder, a plunger which advances and retracts in the injection cylinder, and an injection nozzle in a front end of the injection cylinder. The melting device and the injection portion are coupled by a coupling member. The interior of the melting cylinder and the interior of the injection cylinder are communicated by a communication passage included in the coupling member. The communication passage is opened and closed by a backflow prevention device. The melting cylinder, the injection cylinder, the coupling member and the injection nozzle are heated by winding a heater around the outer periphery.

The melting cylinder melts a light metal material supplied from outside into a molten material equivalent to the above-described melt and supplies the molten material to the injection cylinder through the communication passage. At this time, the backflow prevention device opens the communication passage. The inert gas supplying device supplies the inert gas above the molten material in the melting cylinder. The molten material in the melting cylinder is covered above a liquid level by the inert gas supplied from the inert gas supplying device.

The injection cylinder makes the plunger retract to measure the molten material supplied from the melting cylinder. The backflow prevention device closes the communication passage when the measurement ends. The injection cylinder makes the plunger advance to inject the molten material to a cavity space inside a mold through the injection nozzle. The molten material is cooled in the mold device and solidifies into desirable molded articles.

The backflow prevention device has a valve rod and a valve rod driving device which drives the valve rod. The valve rod passes through the melting cylinder and is seated on a valve seat inside the melting cylinder. The valve seat is formed around an opening on a melting cylinder side of the communication passage which opens on an inner peripheral surface of a cylinder hole of the melting cylinder.

A backflow prevention device of an injection device of light metal injection molding machine of patent literature 2 has a valve rod, a valve rod driving device which drives the valve rod, and a double pipe for flowing a cooling fluid in the valve rod. A seal seat equivalent to the above-described valve seat is formed around an opening on an injection cylinder side of a communication passage which opens on an inner-hole surface of an injection cylinder. The valve rod passes through the injection cylinder and is seated on the seal seat inside the injection cylinder.

The double pipe inside the valve rod is covered by a heat-insulating material in parts expect a front end of the valve rod in order to cool only the front end of the valve rod. A semisolid resulting from semi-solidification of a molten material is attached to the valve rod around the cooled front end. The semisolid fills a gap following the space between the valve rod and the seal material when the valve rod is seated on the seal seat to more effectively prevent backflow of the molten material. The semisolid is heated and melted by the molten material around if the cooling medium does not flow.

LITERATURE OF RELATED ART

Patent Literature

Patent Literature 1: US2018117671

Patent Literature 2: Japanese Laid-Open No. 2005-199335

The gas slightly remained inside the injection cylinder is discharges out of the mold device from an air vent included in the mold device when injected into the mold device together with the melt. However, a small amount of gas which is not discharged causes formation of cavities in the molded articles. Therefore, desirably, the gas remains in the injection cylinder as little as possible.

In a case that the gap between the valve seat and the valve rod seated on the valve seat is filled by the semisolid of the melt when the communication passage is closed, when the communication passage is opened, even if the valve rod is separated from the valve seat, the semisolid is not melted at once and the semisolid blocks the opening of the communication passage for a while, causing the flow of the melt inside the communication passage to be slowed down. Therefore, desirably, the semisolid which is attached to and remains in the valve seat is removed as much as possible immediately after the valve rod is separated from the valve seat.

The disclosure provides an injection device of light metal injection molding machine and an injection control method thereof, the injection device of light metal injection molding machine being capable of discharging the gas slightly remained inside the injection cylinder into the melting cylinder to prevent generation of cavities inside the molded articles and further supplying the melt from the melting cylinder to the injection cylinder quickly with a sufficient flow rate immediately after the communication passage is opened. Additional objects and advantages of the disclosure will be set forth in the description that follows.

SUMMARY

The injection control method of the injection device of light metal injection molding machine of the disclosure is an injection control method of an injection device of light metal injection molding machine 1 in which a melt of a light metal material in a supply unit 2 is supplied into an injection unit 3 through a communication passage 40, a plunger 32 included in the injection unit is retracted and the melt of a predetermined volume in the injection unit is measured, the communication passage is closed and the plunger is advanced to inject the melt in the injection unit into a mold device 8 through an injection nozzle 35 included in the injection unit. In the injection control method, after the melt is injected and before the melt is measured, the plunger is advanced at a pressure at which the melt in the injection unit does not come out from the injection nozzle and at least part of the melt in the injection unit is flowed back into the supply unit through the opened communication passage.

The injection device of light metal injection molding machine of the disclosure includes: a supply unit 2 which supplies a melt of a light metal material; an injection unit 3 in which a plunger 32 advancing and retracting is disposed and to which an injection nozzle 35 is connected; a coupling member 4 which couples the supply unit and the injection unit, and in which a communication passage 40 communicating the interior of the supply unit and the interior of the injection unit is formed; a backflow prevention device 5 which opens and closes the communication passage; and an injection control unit 70 which controls the supply unit, the injection unit and the backflow prevention device, carries out a series of control that the melt in the supply unit is supplied into the injection unit through the communication passage, the plunger is retracted to measure the melt of a predetermined volume in the injection unit, the communication passage is closed, and the plunger is advanced to inject the melt in the injection unit into a mold device 8 through the injection nozzle, and carries out a series of control that after the melt is injected and before the melt is measured, the plunger is advanced at a pressure at which the melt in the injection unit does not come out from the injection nozzle, and at least part of the melt in the injection unit is flowed back into the supply unit through the opened communication passage.

DESCRIPTION OF THE EMBODIMENTS

The injection device of light metal injection molding machine of the disclosure and the injection control method thereof can prevent the generation of cavities formed in the molded articles, and quickly supply the melt to the injection unit.

Figure 1:
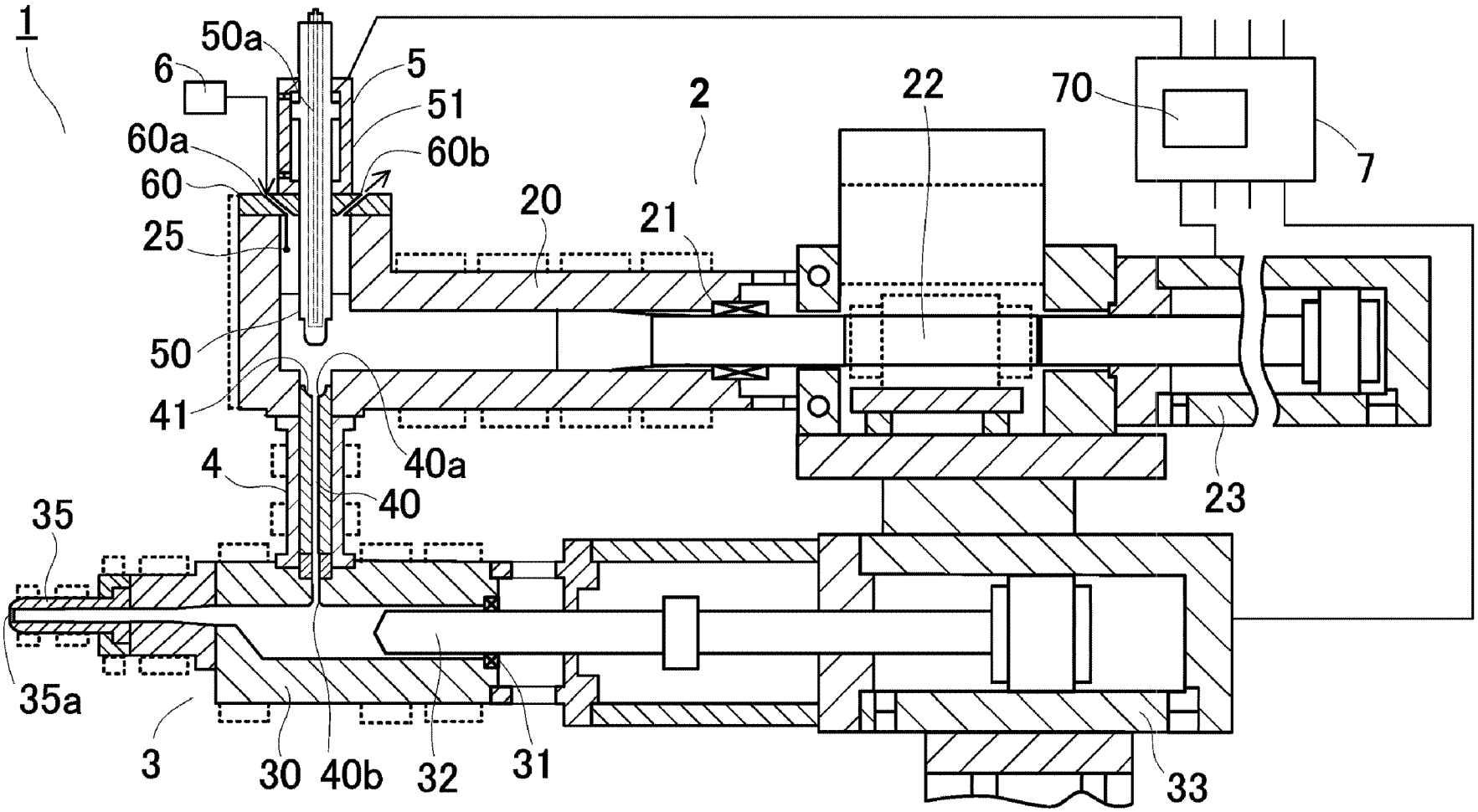
FIG. 1 is a schematic diagram illustrating a basic configuration of an injection device of light metal injection molding machine of the disclosure.
Figure 2:
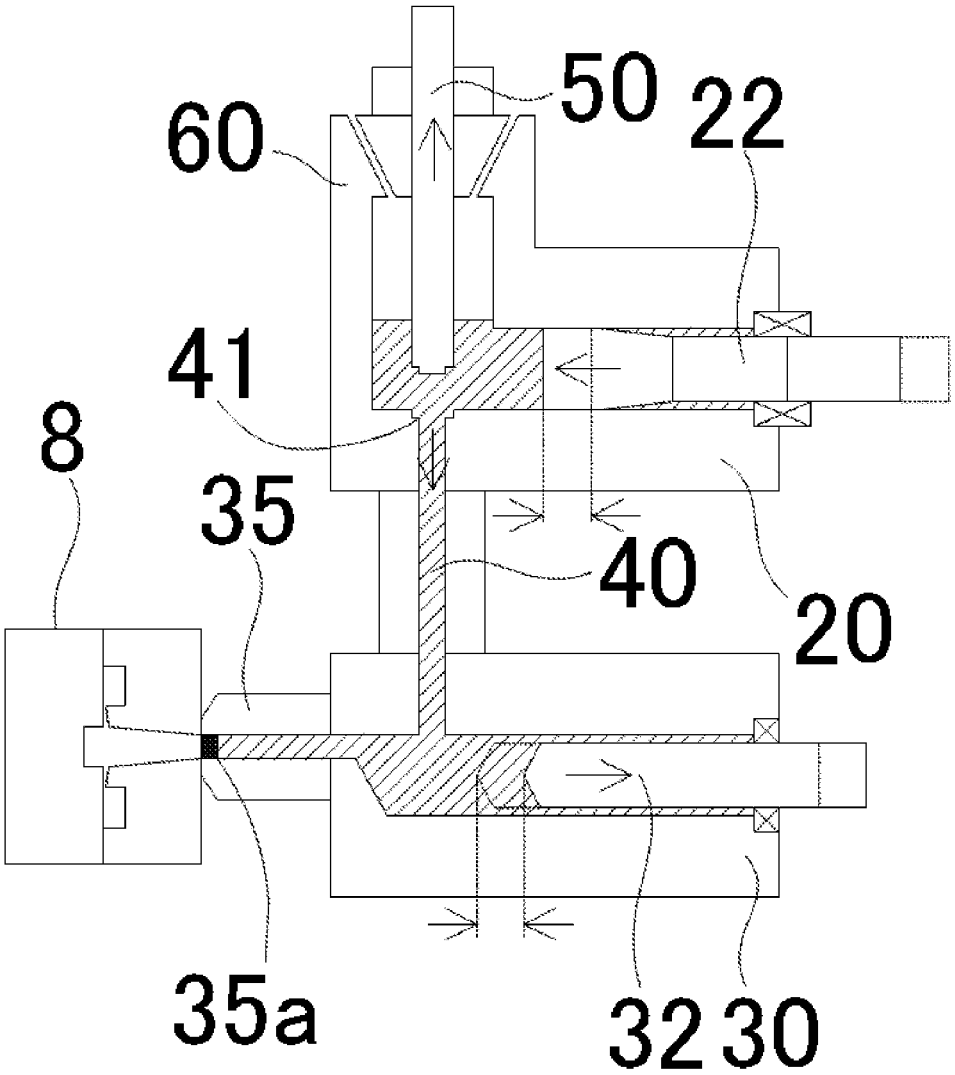
FIG. 2 is a schematic diagram illustrating the injection device of the disclosure when a melt is measured.
Figure 3:
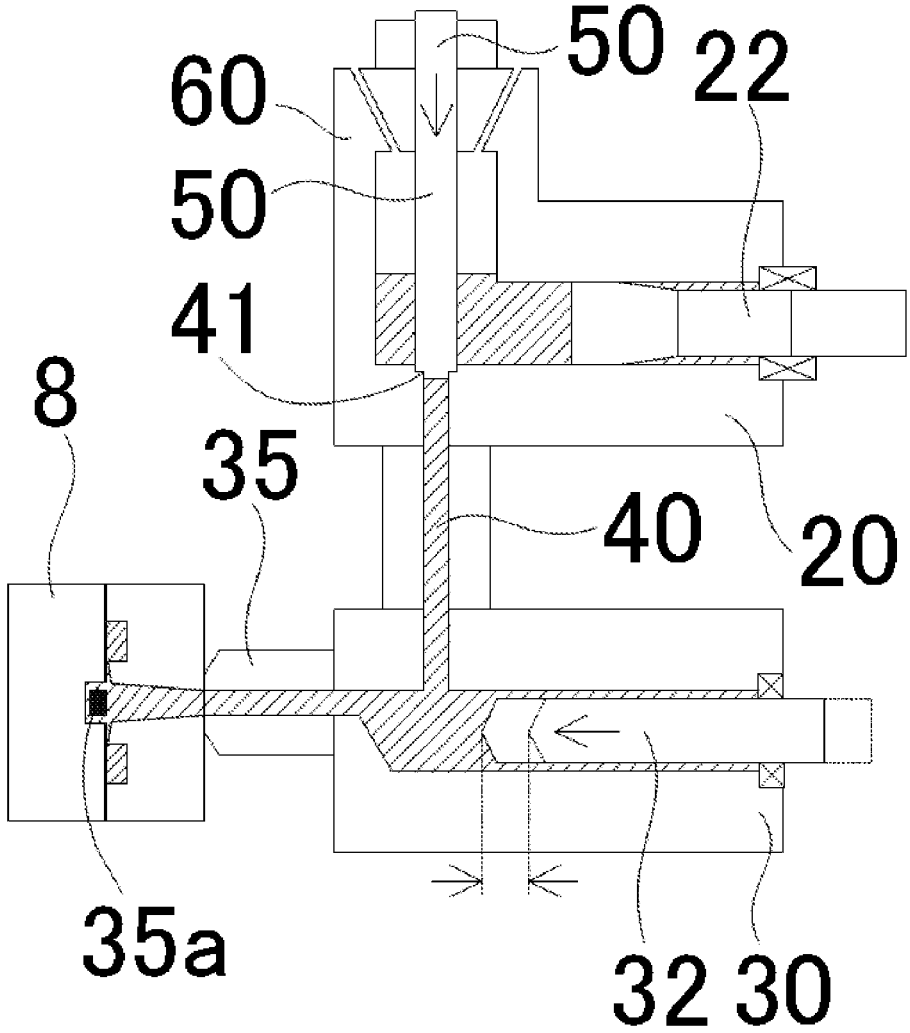
FIG. 3 is a schematic diagram illustrating the injection device of the disclosure when the melt is injected to a mold device.
Figure 4:
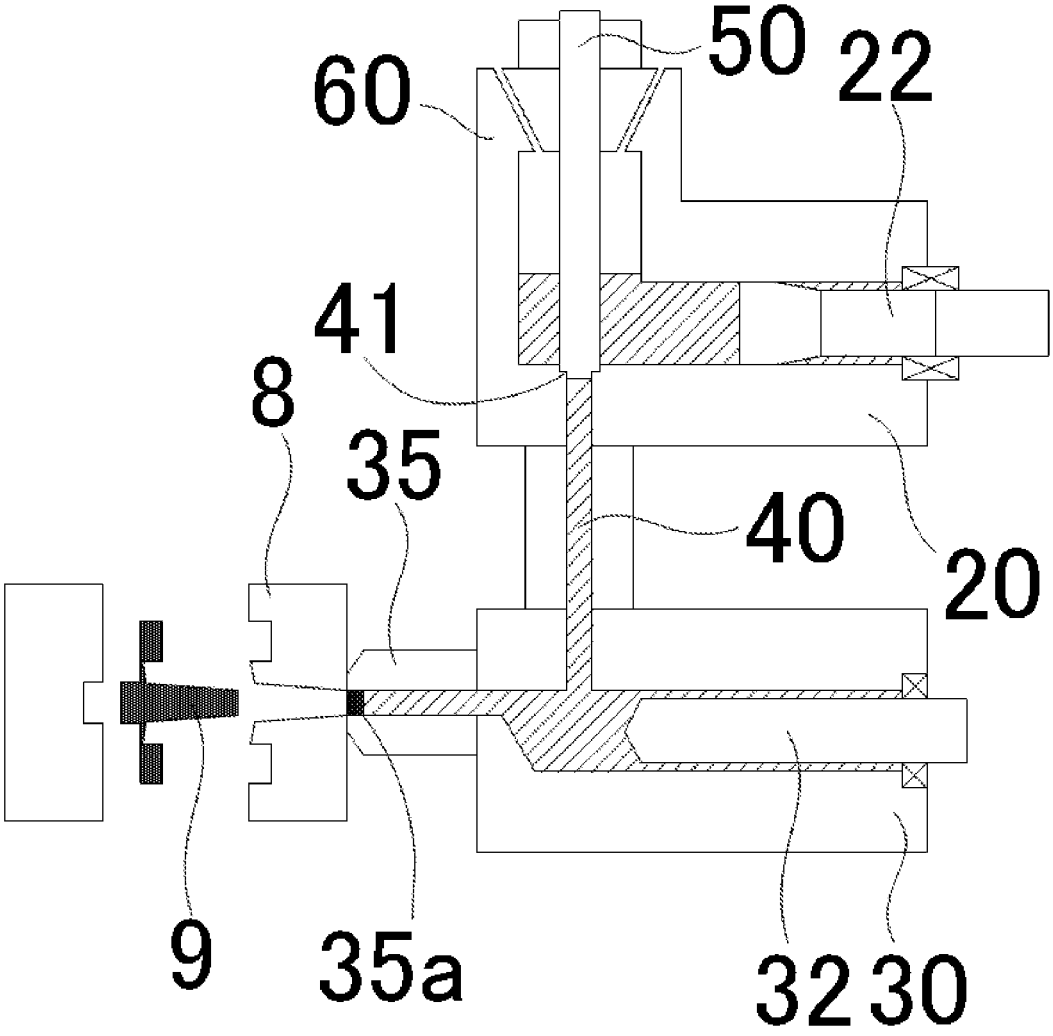
FIG. 4 is a schematic diagram illustrating the injection device of the disclosure when the mold device is opened and a molded article is taken out.
Figure 5:
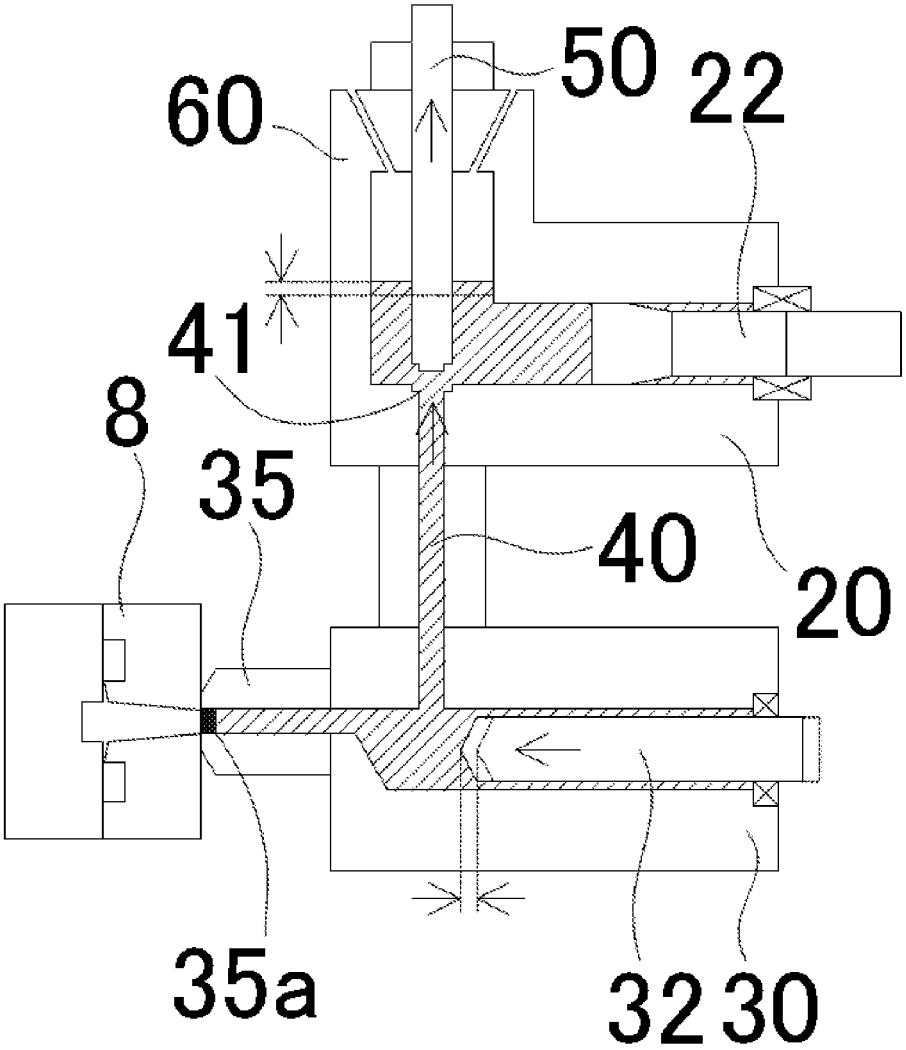
FIG. 5 is a schematic diagram illustrating the injection device of the disclosure when a plunger is advanced to make the melt flow back after the injection.
Figure 6:
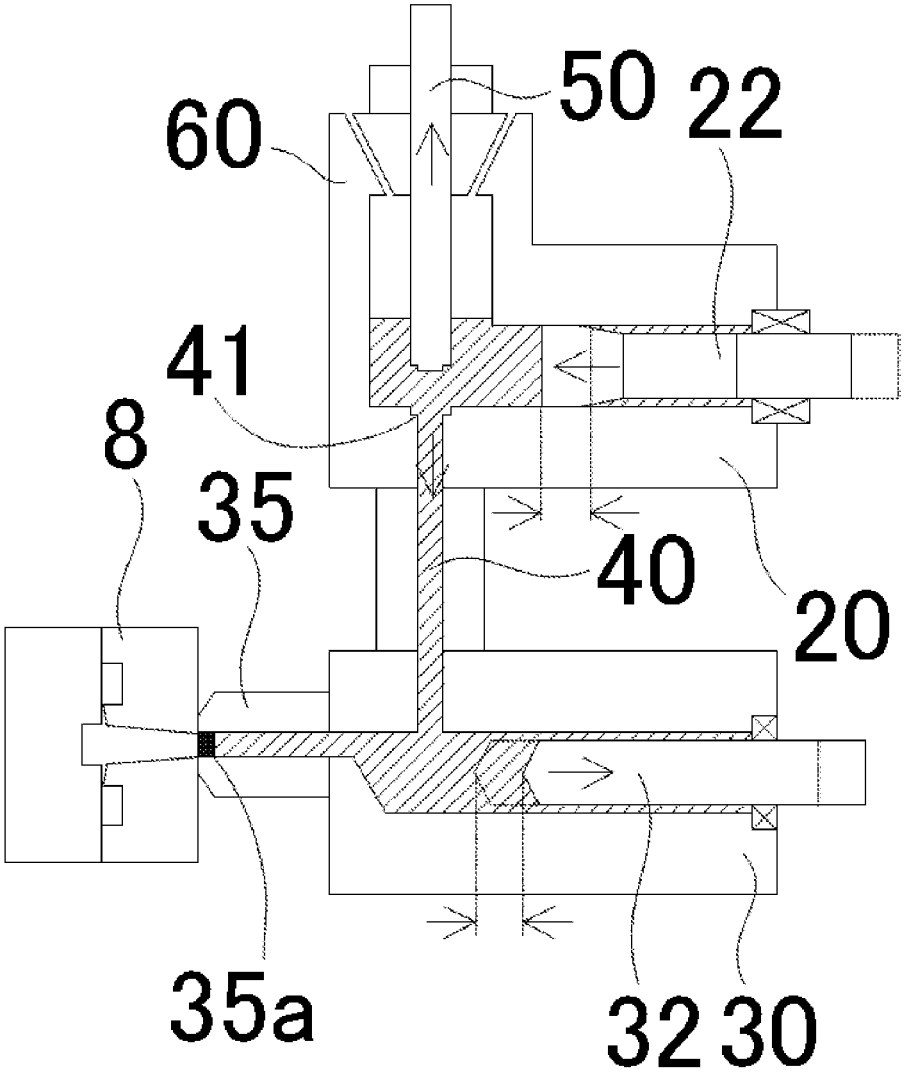
FIG. 6 is a schematic diagram illustrating the injection device of the disclosure when the plunger is retracted to replenish the melt after the injection.
Figure 7:
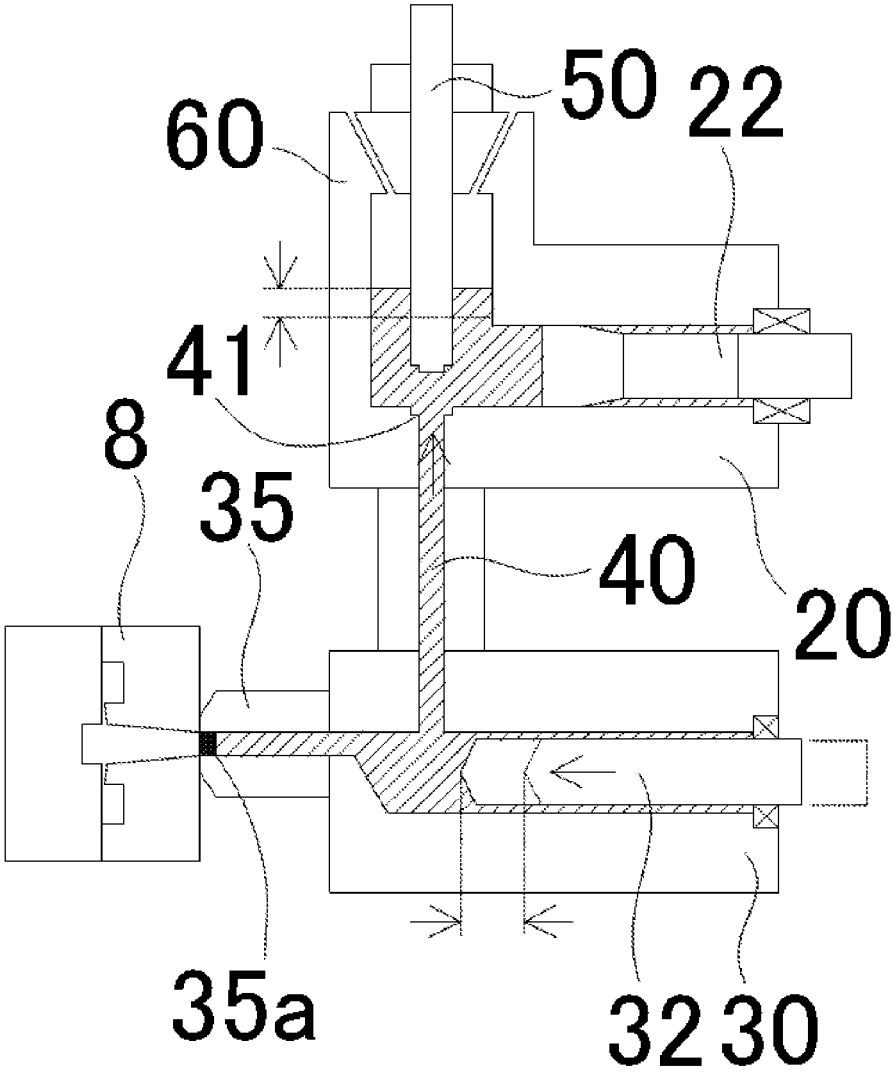
FIG. 7 is a schematic diagram illustrating the injection device of the disclosure when the melt flows back after the melt is replenished.
Figure 8:
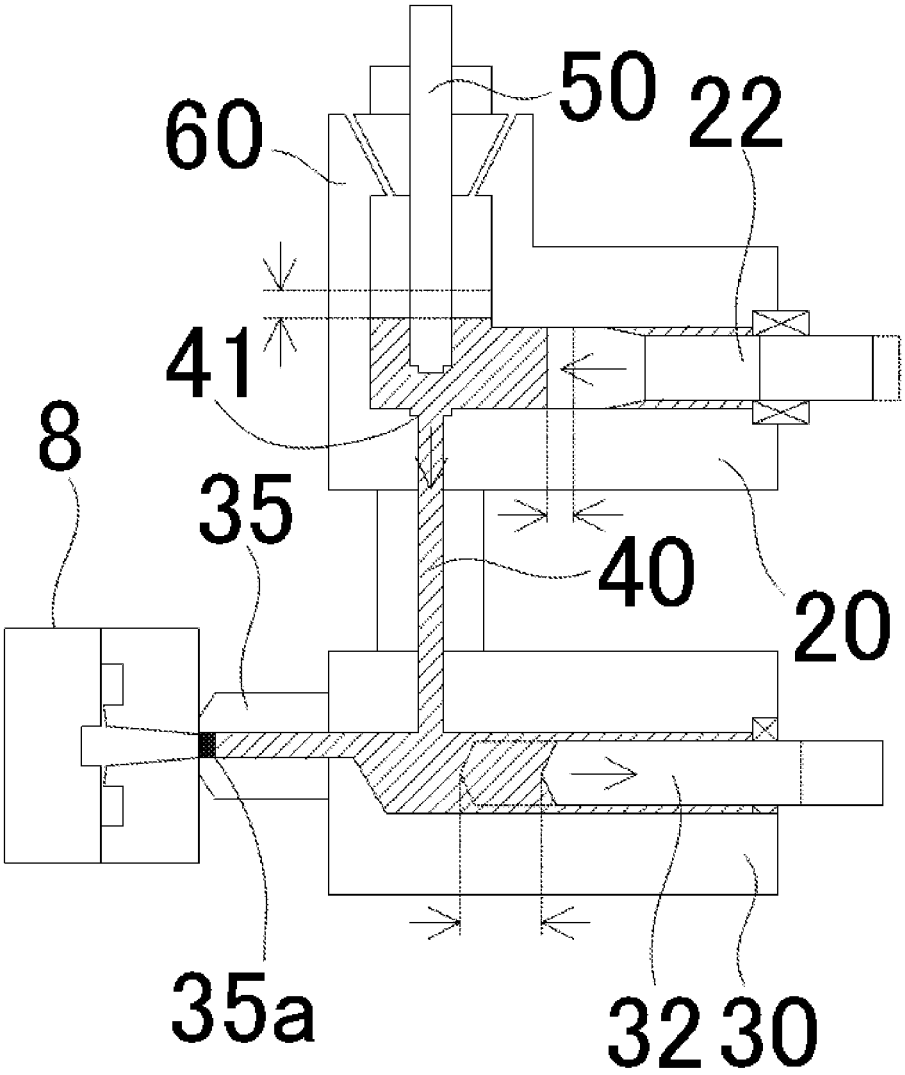
FIG. 8 is a schematic diagram illustrating the injection device of the disclosure when the melt is measured after the melt flows back.
Figure 9:
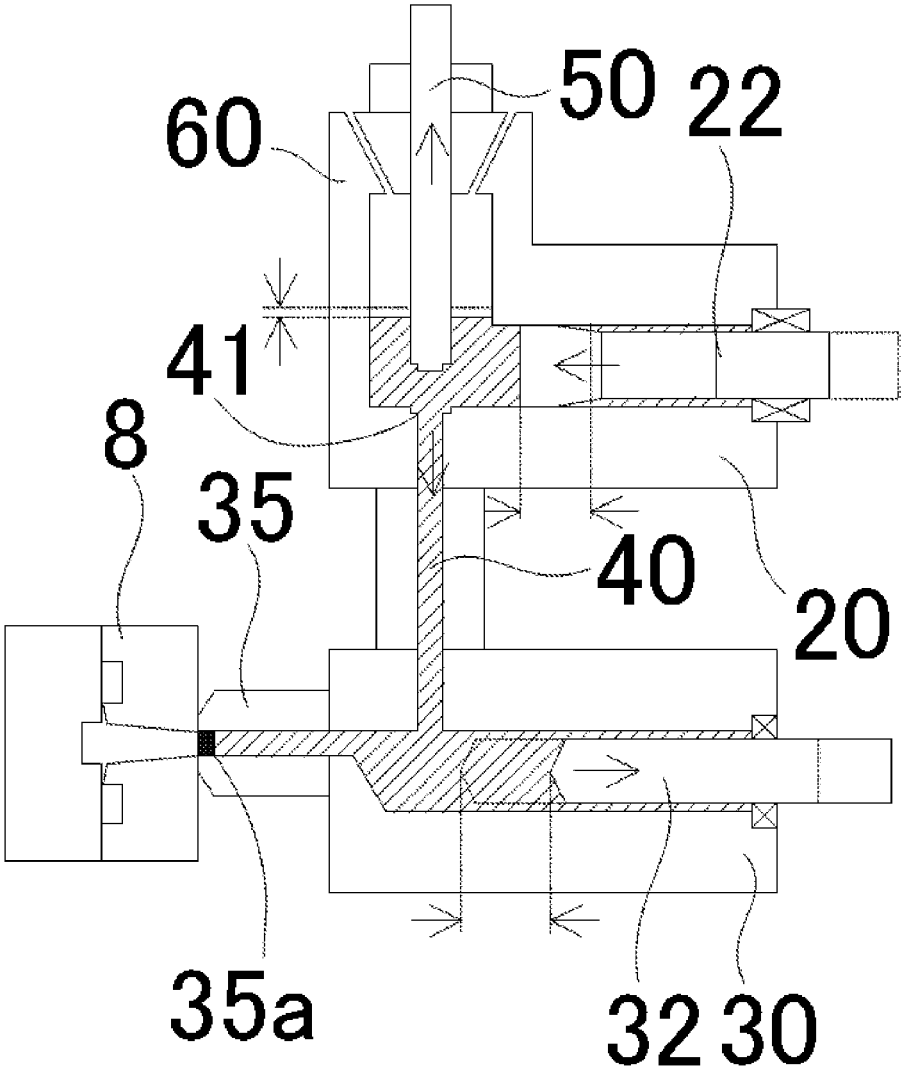
FIG. 9 is a schematic diagram illustrating the injection device of the disclosure when the plunger is retracted to replenish the melt of a volume greater than the measured volume after the injection.
Figure 10:
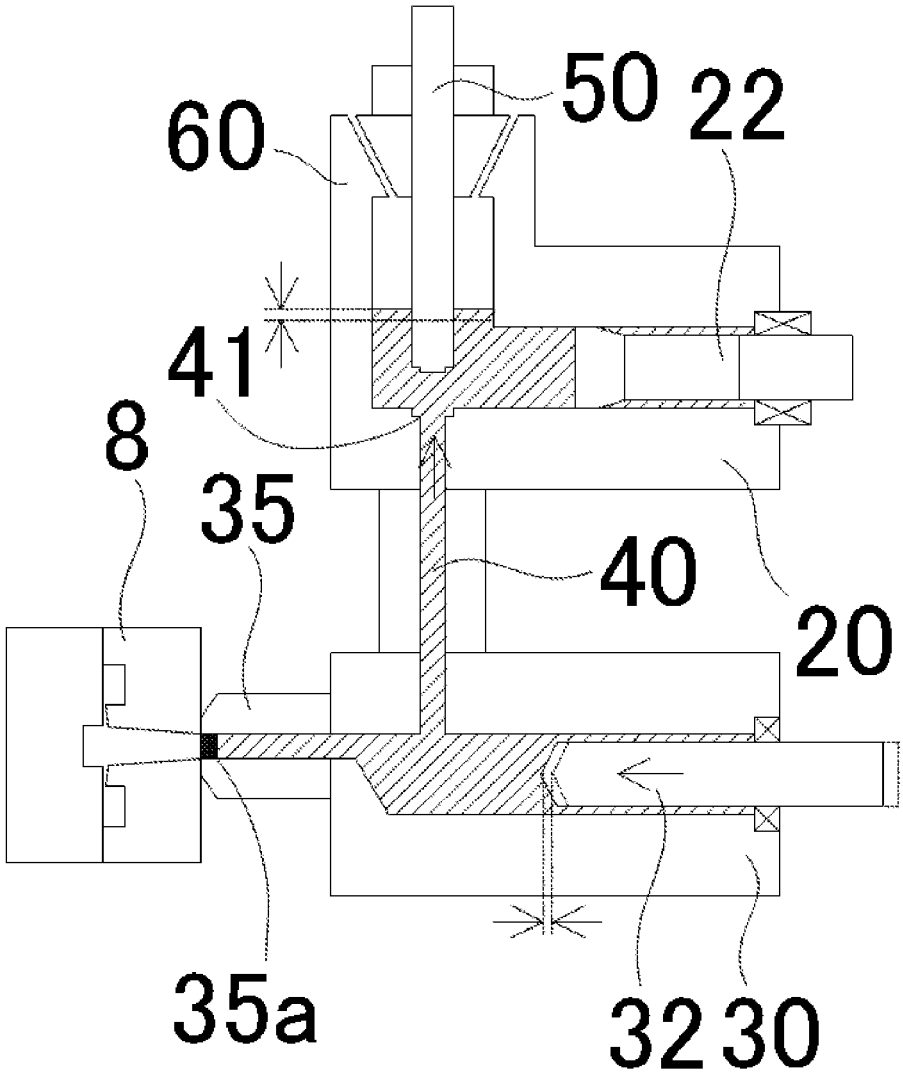
FIG. 10 is a schematic diagram illustrating the injection device of the disclosure when the measured melt is remains and the melt flows back after the melt of a volume greater than the measured volume is replenished.

A basic configuration of an injection device of light metal injection molding machine 1 of the disclosure is shown in FIG. 1. Basic operations of the injection device 1 in an injection control method of the injection device of light metal injection molding machine 1 of the disclosure are shown in FIG. 2 to FIG. 7. FIG. 1 shows the injection device 1. FIG. 2 shows the injection device 1 when a melt is measured. FIG. 3 shows the injection device 1 when the melt is injected to a mold device 8. FIG. 4 shows the injection device 1 when the mold device 8 is opened and a molded article 9 is taken out. FIG. 5 shows the injection device 1 when a plunger 32 is advanced to make the melt flow back after the injection. FIG. 6 shows the injection device 1 when the plunger 32 is retracted to replenish the melt after the injection. FIG. 7 shows the injection device 1 when the melt flows back after the melt is replenished. FIG. 8 shows the injection device 1 when the melt is measured after the melt flows back. FIG. 9 shows the injection device 1 when the plunger 32 is retracted to replenish the melt of a volume greater than the measured volume after the injection. FIG. 10 shows the injection device 1 when the measured melt is remains and the melt flows back after the melt of a volume greater than the measured volume is replenished.

The light metal injection molding machine has the injection device 1, a mold clamping device, and a control device 7 which controls the injection device 1 and the mold clamping device. The injection device 1 and the control device 7 are shown in FIG. 1. Illustration of the mold clamping device is omitted. The mold device 8 is mounted on the mold clamping device. Illustration of the mold device 8 is omitted. The mold device 8 is opened and closed and clamped by the mold clamping device. The control device 7 includes an injection control unit 70 which controls the injection device 1. Furthermore, specific description of a driving source which drives various devices is omitted, and various types of driving sources such as a hydraulic type, a pneumatic type or an electric type or the like are suitably used as the driving source.

In the light metal injection molding machine, the mold device 8 is closed by the mold clamping device, the mold is further tightened, the melt of a light metal material is injected toward a cavity space inside the mold device 8 by the injection device 1 to fill the cavity space, and after the melt is cooled and solidified in the mold device 8, the mold device 8 is opened by the mold clamping device and the molded article 9 is taken out.

The light metal injection molding machine has a structure suitable for an injection molding machine in which a molding material is a light metal material. The light metal material in the disclosure refers to a metal having a specific gravity of 4 or less. In practical use, aluminum and magnesium are particularly effective as the mold material. When the mold material is aluminum, in order not to be melted away, a site in contact with the molding material is basically coated with a cermet-based material.

The injection device 1 shown in FIG. 1 has a supply unit 2 and an injection unit 3. The supply unit 2 supplies the melt to the injection unit 3. The supply unit 2 is described below taking a melting unit 2 as one example. The melting unit 2 has a melting cylinder 20. The injection unit 3 has an injection cylinder 30. The melting cylinder 20 and the injection cylinder 30 are coupled by a coupling member 4. The interior of the melting cylinder 20 and the interior of the injection cylinder 30 are communicated by a communication passage 40 formed in the coupling member 4. The communication passage 40 is opened and closed by a backflow prevention device 5. The injection cylinder 30, the melting cylinder 20, and the coupling member 4 are heated by winding a heater around the outer periphery.

The melting unit 2 shown in FIG. 1 has a billet extrusion device 23. The billet extrusion device 23 sequentially pushes a round-bar light metal material of a predetermined length (hereinafter, referred to as billet 22) into the melting cylinder 20. The melting cylinder 20 is horizontally arranged above the injection cylinder 30. The coupling member 4 is connected to a lower portion on a front end side of the melting cylinder 20. A melting cylinder side opening 40*a* of the communication passage 40 is open on a front end side of a cylinder hole of the melting cylinder 20 and on a lower portion of the cylinder hole. The temperature of the billet 22 rises as the billet 22 advances in the melting cylinder 20 which is heated by the heater, and melting of the billet 22 is started when the billet 22 passed the front half of the melting cylinder 20. The billet 22 is enlarged in diameter at a softened portion before melting by advancing. The enlarged-diameter portion of the billet 22 slidably abuts against the cylinder hole of the melting cylinder 20 to seal the space between the melting cylinder 20 and the billet 22. The billet 22 extrudes the melt inside the melting cylinder 20 forward by advancing. The melting cylinder may be arranged obliquely taking a front end side as the downward side and a rear end side as the upward side.

The cylinder hole of the melting cylinder 20 is formed in a manner that an inner diameter is smaller at a rear end than at other portions and is larger than an outer diameter of the billet 22. The melting cylinder 20 has a reduced-diameter portion 21 in the rear end. An inner diameter of the reduced-diameter portion 21 is formed smaller than the inner diameter of the cylinder hole of the melting cylinder 20 and larger than the outer diameter of the billet 22. The melting cylinder 20 and the reduced-diameter portion 21 may be integrally formed.

In the melting cylinder 20, the temperature of the heater in the rear end is controlled to generate a seal member being a solid which is in a state of being softened to an extent that the melt exists between the reduced-diameter portion 21 and the billet 22 and which is solidified to an extent that backflow of the melt is prevented. The seal member seals the space between the rear end of the melting cylinder 20 and the billet 22 to prevent leakage of the melt. The seal member reduces the friction between the melting cylinder 20 and the billet 22 to allow smooth movement of the billet 22. By being caught in an annular groove formed on an inner peripheral surface of the reduced-diameter portion 21 or a step between the cylinder hole of the melting cylinder 20 and the reduced-diameter portion 21, the seal member does not come off from the rear end of the melting cylinder 20 even under a pressure of the melt.

In addition, the melting cylinder 20 shown in FIG. 1 has an inert gas storage portion 60. The inert gas storage portion 60 is arranged on an upper portion on the front end side of the melting cylinder 20 arranged horizontally and communicates with the interior of the melting cylinder 20. The inert gas storage portion 60 contains the excessive melt in the melting cylinder 20 and makes an inert gas atmosphere above the melt which is contained. The inert gas storage portion 60 has an inert gas supply port 60*a* and an inert gas discharge port 60*b*. The inert gas supply port 60*a* is connected to an inert gas supplying device 6 which is not illustrated. The inert gas discharge port 60*b* is communicated with the outside through a relief valve. In order to maintain the pressure of the inert gas inside the inert gas storage portion at a constant level, the relief valve opens a valve to discharge the inert gas to the outside when a predetermined pressure is exceeded. The inert gas supplying device 6 constantly or timely supplies the inert gas into the inert gas storage portion at a desirable flow rate.

The inert gas storage portion 60 gathers various gas such as the inert gas or air or the like which intrudes into the melting cylinder 20, the injection cylinder 30, and the communication passage 40. In the inert gas storage portion 60, the atmosphere of the inert gas is maintained at the predetermined pressure, the inert gas is constantly or timely supplied, and the gas such as air or the like is discharged to the outside. The inert gas is, for example, preferably argon gas (Ar). Argon gas has a higher specific gravity than air. Height of a liquid level of the melt inside the inert gas storage portion 60 may be detected by a liquid level sensor 25. The inert gas storage portion 60 is designed to be capable of containing a required volume from a volume less than one shot to a volume for a plurality of shots as long as the excessive melt inside the melting cylinder 20 can be contained.

The injection unit 3 shown in FIG. 1 has an injection cylinder 30, an injection nozzle 35, and the plunger 32. The injection cylinder 30 is horizontally disposed below the melting cylinder 20. The injection nozzle 35 is arranged at a front end of the injection cylinder 30. The plunger 32 is advanced or retracted by a plunger driving device 33. The coupling member 4 is connected to an upper portion on the front end side of the injection cylinder 30. An injection cylinder side opening 40*b* of the communication passage 40 is open on a front end side of a cylinder hole of the injection cylinder 30 and an upper portion of the cylinder hole.

The cylinder hole of the injection cylinder 30 is formed in a manner that an inner diameter is smaller at a rear end than at other portions and is larger than an outer diameter of the plunger 32. The injection cylinder 30 has a reduced-diameter portion 31 at the rear end. An inner diameter of the reduced-diameter portion 31 is formed smaller than the inner diameter of the cylinder hole of the injection cylinder 30 and larger than the outer diameter of the plunger 32. The injection cylinder 30 and the reduced-diameter portion 31 may be integrally formed.

In the injection cylinder 30, the temperature of the heater in the rear end is controlled to generate a seal member being a solid which is in a state of being softened to an extent that the melt exists between the reduced-diameter portion 31 and the plunger 32 and which is solidified to an extent that backflow of the melt is prevented. The seal member seals the space between the rear end of the injection cylinder 30 and the plunger 32 to prevent the leakage of the melt. The seal member reduces the friction between the injection cylinder 30 and the plunger 32 to allow smooth movement of the plunger 32. By being caught in an annular groove formed on an inner peripheral surface of the reduced-diameter portion 31 or a step between the cylinder hole of the injection cylinder 30 and the reduced-diameter portion 31, the seal member does not come off from the rear end of the injection cylinder 30 even under a pressure of the melt.

The backflow prevention device 5 shown in FIG. 1 has a valve rod 50. The valve rod 50 is advanced or retracted with respect to a valve seat 41 through the inert gas storage portion 60 by a valve rod driving device 51 which is included in an upper portion of the inert gas storage portion 60. The valve seat 41 is formed around a supply unit side opening of the communication passage 40 which is open inside the supply unit 2. For example, the valve seat 41 is formed around the melting cylinder side opening 40*a* of the communication passage 40 which is open inside the melting cylinder 20. The valve rod 50 is seated on the valve seat 41 inside the melting cylinder 20. The valve rod 50 descends to be seated on the valve seat 41 to close the communication passage 40, and rises to be separated from the valve seat 41 to open the communication passage 40. The valve rod 50 is seated on the valve seat 41 against an injection pressure to close the communication passage 40. The valve rod 50 may have a cooling piping 50*a* inside which a cooling medium flows to cool a front end of the valve rod 50. For example, the valve rod 50 may be cooled at the front end before seated on the valve seat 41 to form a solid in a state of being softened to an extent that the melt exists around the front end. The solid at the front end of the valve rod 50 can deform following the valve seat 41 to eliminate a gap between the valve rod 50 and the valve seat 41 when the valve rod 50 is seated on the valve seat 41, thereby further preventing the leakage of the melt which has high fluidity. The solid at the front end of the valve rod 50 can maintain high sealing performance even if surface roughness of the surface on which the valve seat 41 and the valve rod 50 abut against each other is great. The solid at the front end of the valve rod 50 can achieve sufficient sealing performance even if a pressure for pressing the valve rod 50 against the valve seat 41 is small, and thus durability of the valve seat 41 and the valve rod 50 is improved.

The injection device 1 of the embodiment shown in FIG. 1 basically has the melt sealed inside the device. In the injection device 1, for example, the billet 22 is supplied into the melting cylinder 20 or the inert gas is supplied into the inert gas storage portion 60 in order to replenish the melt by an amount of the melt which moves from the melting cylinder 20 into the injection cylinder 30 through the communication passage 40 in accordance with the plunger 32 which is retracted inside the injection cylinder 30. For example, the melt which is replenished or measured from the melting cylinder 20 into the injection cylinder 30 falls by its own weight from the melting cylinder 20 into the injection cylinder 30 due to a difference in height between the melting cylinder 20 and the injection cylinder 30. In addition, for example, the melt is drawn from the melting cylinder 20 by the plunger 32 which is retracted inside the injection cylinder 30. In addition, for example, the melt is extruded into the injection cylinder 30 by the pressure of the inert gas which is supplied into the inert gas storage portion 60 communicating with the interior of the melting cylinder 20. In addition, for example, the melt is extruded into the injection cylinder 30 by the billet 22 which is advanced inside the melting cylinder 20.

The injection control unit 70 shown in FIG. 1 controls the injection device 1 as follows. First, the control for filling the interior of the melting cylinder 20 with melt is carried out. The backflow prevention device 5 closes the communication passage 40. The billet extrusion device 23 supplies the billet 22 that is unmelted into the melting cylinder 20. The billet 22 is melted into melt inside the melting cylinder 20. The melting cylinder 20 may store the melt of a sufficient volume more than one shot and corresponding to the time of a molding cycle inside the cylinder. The melting cylinder 20 may store the melt of a volume which is greater in a case when the time of one molding cycle is shorter than in a case when the time is longer even if the volume for one shot is the same. The inert gas storage portion 60 which communicates with the melting cylinder 20 has a sufficient space for containing the melt flowing back from the injection cylinder 30 into the melting cylinder 20 and fills inert gas above the melt. The inert gas storage portion 60 can also contain the melt in advance in order to replenish the melt into the injection cylinder 30 as described later.

Next, the control for the molding cycle is carried out. One molding cycle is as below. As shown in FIG. 2, the mold clamping device closes the mold device 8. The mold clamping device further tightens the closed mold device 8. The backflow prevention device 5 opens the communication passage 40. The billet 22 is advanced and the melt inside the melting cylinder 20 is supplied into the injection cylinder 30 through the communication passage 40. A position where the plunger 32 is retracted is detected by a position detector not illustrated, and the amount of the predetermined melt is measured inside the injection cylinder 30. At this time, the front end of the injection nozzle 35 is sealed by a cold plug 35*a* which is obtained by cooling and solidifying the melt. As shown in FIG. 3, the backflow prevention device 5 closes the communication passage 40. The plunger 32 is advanced until a predetermined position to inject the melt which is measured inside the injection cylinder 30. The melt is injected into the cavity space of the mold device 8 being clamped through the injection nozzle 35 by a great injection pressure. At this time, the cold plug 35*a* is also injected together. The melt solidifies quickly when injected into the cavity space. The plunger 32 may apply a predetermined holding pressure to the melt inside the cavity space via the melt remaining inside the injection cylinder 30 until the melt in a gate portion of the cavity space solidifies as necessary, or until the cold plug 35*a* is generated. As shown in FIG. 4, advancing of the plunger 32 is stopped to reduce the injection pressure or the holding pressure. The mold clamping device opens the mold device 8. The molded article 9 is taken out from the opened mold device 8. The molding cycle is carried out repeatedly. Furthermore, the advanced billet 22 is melted into melt from a portion reaching the front half inside the melting cylinder 20.

The cold plug 35*a* is a solid which is generated in a manner that the melt inside the injection nozzle 35 is cooled and solidifies at the front end of the injection nozzle 35. The injection nozzle 35 is heated by the heater. The temperature of the front end of the injection nozzle 35 can rise and drop at a predetermined timing by temperature control of the heater. In addition, the front end of the injection nozzle 35 is deprived of heat by the mold device 8 when abutting against the mold device 8 and the temperature drops. The cold plug 35*a* comes off from the injection nozzle 35 under the great injection pressure when the melt is injected to the mold device 8 and the cold plug 35*a* is injected into the mold device 8 together with the melt. As shown in FIG. 2, in the cavity space of the mold device 8, a cold slag well for containing the cold plug 35*a* is formed in a portion different from the portion of a product. Furthermore, the means for opening and closing the injection nozzle 35 is preferably the means in which the cold plug 35*a* is used to open and close; however, mechanisms such as a mechanism that opens and closes a nozzle tip by a lid member or a mechanism that opens and closes in halfway of a flow path with a valve may be employed.

Then, the configuration unique to the disclosure is described. The injection control unit 70 shown in FIG. 1 controls the injection device 1 as below at a frequency of once for every cycle or every plural cycles in the repeated molding cycles in the duration after the advancing of the plunger 32 is stopped to reduce the injection pressure or the holding pressure and before the melt is measured again. As shown in FIG. 5, in the injection device 1, the communication passage 40 is opened, and the plunger 32 is advanced to make at least part of the melt inside the injection cylinder 30 flow back into the melting cylinder 20 through the communication passage 40. The plunger 32 is advanced under a pressure at which the cold plug 35*a* does not come off from the injection nozzle 35. Among the melt that flows back, the melt overflowing from the melting cylinder 20 is contained inside the inert gas storage portion 60. The backflow of the melt is preferably carried out each time before carrying out the measurement.

After the melt is injected, a small amount of the melt remains inside the injection cylinder 30, and the plunger 32 stops, for example, in front of the injection cylinder side opening 40*b* of the communication passage 40 inside the injection cylinder 30. The amount of the melt remaining inside the injection cylinder 30 after the melt is injected is called a cushion amount. The communication passage 40 is opened, the plunger 32 is further advanced for a shorter distance, and the melt inside the injection cylinder 30 flows back into the melting cylinder 20 through the communication passage 40. In the embodiment shown in FIG. 1, preferably, the plunger 32 is not advanced beyond the injection cylinder side opening 40*b* of the communication passage 40. A volume of the flowing-back melt is small. The flowing-back melt is cooled at the front end of the valve rod 50, and the semisolid of melt which is attached to the melting cylinder side opening 40*a* of the communication passage 40 and the valve seat 41 around the melting cylinder side opening 40*a* is quickly removed.

The removed semisolid is heated by the flowing-back melt and the melt around the destination to which the semisolid moves and is melted into melt again. The removed semisolid is quickly melted into melt again and does not disturb the movement of the melt which flows to the injection cylinder 30 from the melting cylinder 20 through the communication passage 40. A distance by which the valve rod 50 is separated from the valve seat 41 is set smaller than the distance at the time of the measurement, and thereby the flowing-back melt can spout vigorously between the valve seat 41 and the valve rod 50 to more effectively remove the semisolid of the melt. The distance by which the valve rod 50 is separated from the valve seat 41 may be a distance equal to or less than 20% of an inner diameter of the communication passage 40, preferably a distance equal to or less than 10% of the inner diameter of the communication passage 40. For example, when the inner diameter of the communication passage 40 is 10 mm, the distance by which the valve rod 50 is separated from the valve seat 41 may be equal to or less than 2 mm, preferably equal to or less than 1 mm. The flow of the melt from the melting cylinder 20 into the injection cylinder 30 through the communication passage 40 becomes smooth. Particularly, even if the melt moves through the communication passage 40 into the injection cylinder 30 under its own weight or a low pressure, the melt can also start moving quickly. Moreover, the semisolid is generated anew after the previous semisolid and an oxidized solid are forcibly removed, and thereby the softened state can be kept constant. The situation in which part of the semisolid is solidified and a gap is formed between the valve seat 41 and the valve rod 50 which are in a backflow prevention state can be prevented.

Part of the various gases accumulated in the vicinity of the injection cylinder side opening 40*b* of the communication passage 40 in the injection cylinder 30 rises through the communication passage 40 being opened and is discharged into the melting cylinder 20. However, a small amount of the various gases remains inside the injection cylinder 30. For example, the various gases which are accumulated when separated from the injection cylinder side opening 40*b* of the communication passage 40 in the injection cylinder 30 cannot move by opening the communication passage 40 only. In addition, for example, when the measurement starts immediately after the communication passage 40 is opened, due to the melt which flows into the injection cylinder 30, the various gases are moved to a position separated from the communication passage 40 in the injection cylinder 30. The flowing-back melt forcibly moves the various gases existing inside the injection cylinder 30 into the melting cylinder 20. The various gases inside the injection cylinder 30 are removed. The melt is measure inside the injection cylinder 30 after the various gases are removed. The melt injected into the mold device 8 does not include the various gases. Therefore, generation of cavities in the molded article 9 can be prevented. In addition, because there is no gas inside the injection cylinder 30, accuracy of measuring the melt is improved. The melt which is measured has no variation in volume for each measurement.

After the melt is injected and before the melt flows back, as shown in FIG. 6, the communication passage 40 may be opened, the billet 22 may be advanced and the plunger 32 may be retracted to replenish the melt of a predetermined volume from the melting unit 2 into the injection cylinder 30. The replenished melt may be, for example, at a volume the same as the measured volume. The replenished melt may be, for example, at a maximum volume that can be contained inside the injection cylinder 30 when the plunger 32 retracts to a limit position where the plunger 32 can be retracted. The replenished melt can be set at a necessary volume as long as the replenished melt does not exceed the maximum volume that can be contained inside the injection cylinder 30. By increasing the distance by which the valve rod 50 is separated from the valve seat 41 as much as possible, the melt can be quickly moved between the melting cylinder 20 and the injection cylinder 30 particularly when the melt is measured inside the injection cylinder 30 or when the various gases are removed from the injection cylinder 30 together with the melt. The distance by which the valve rod 50 is separated from the valve seat 41 may be a distance equal to or larger than the inner diameter of the communication passage 40. For example, when the inner diameter of the communication passage 40 is 10 mm, the distance by which the valve rod 50 is separated from the valve seat 41 may be equal to or larger than 10 mm. As shown in FIG. 7, the flowing-back melt is contained inside the inert gas storage portion 60. If there is much flowing-back melt, the semisolid of the melt which is attached to the melting cylinder side opening 40*a* of the communication passage 40 and the valve seat 41 around the melting cylinder side opening 40*a* can be reliably removed. If there is much flowing-back melt, the various gases existing inside the injection cylinder 30 can be moved together with the melt into the melting cylinder 20 separately. When the melt is replenished after the injection, the billet 22 may be supplied to supply the melt inside the melting cylinder 20. In addition, when the melt is replenished after the injection, excessive melt may be prepared inside the melting cylinder 20 in advance, and the melt for replenishment may be contained inside the inert gas storage portion 60 in advance.

After the melt is injected, the melt may not be replenished into the injection cylinder 30, and a small amount of melt may be replenished into the injection cylinder 30 after flowing back into the melting cylinder 20, and again the melt flows back into the melting cylinder 20. The backflow of the melt may be carried out repeatedly after the melt is replenished. By repeating the backflow of the melt for a plurality of times, the flow of the melt passing through the communication passage 40 becomes smoother, and the various gases remaining inside the injection cylinder 30 can be reliably removed. The various gases can also rise through the communication passage 40 to move into the melting cylinder 20 by opening the communication passage 40. The various gases are forcibly moved into the melting cylinder 20 by the melt which flows back from the injection cylinder 30 to the melting cylinder 20. The various gases are easily moved into the melting cylinder 20 by replacing the melt inside the communication passage 40 with the melt which flows back from the injection cylinder 30.

The melt which is measured after the melt flows back may be, for example, as shown in FIG. 8, the melt contained inside the inert gas storage portion 60, or the melt extruded from the melting cylinder 20 when the billet 22 is advanced, or the melt which is a combination thereof. The melt which is measured after the melt flows back does not include the various gases. The generation of cavities can be prevented even in the molded articles that are molded in the first molding cycle.

In addition, as shown in FIG. 9, in the injection device 1, the melt of a volume greater than the measured volume may be replenished into the injection cylinder 30, and as shown in FIG. 10, the melt of the measured volume remains inside the injection cylinder 30, and the melt flows back from the injection cylinder 30 into the melting cylinder 20. The injection device 1 can also complete the operation of measuring the melt at the time point when the operation of making the melt flow back is completed. For example, the injection device 1 can first inject the melt, then make the melt flow back, then replenish the melt of the volume greater than the measured volume, and finally keep the melt of the measured volume and make the melt flow back.

The backflow prevention device 5 shown in FIG. 1 has the valve seat 41 and the valve rod 50 inside the melting cylinder 20, and thus when the melt flows back, the semisolid of the melt which is attached to the melting cylinder side opening 40*a* of the communication passage 40 and the valve seat 41 around the melting cylinder side opening 40*a* is easily removed to the outside of the communication passage 40. However, the backflow prevention device 5 is not limited to the embodiment shown in FIG. 1. Although illustration is omitted, the disclosure can also be applied even in a configuration in which the communication passage 40 is opened and closed from the injection cylinder 30 by the backflow prevention device which has a valve seat and a valve rod inside the injection cylinder 30. Because the valve seat and the valve rod are included inside the injection cylinder 30, when the melt is replenished, the semisolid of the melt which is attached to the injection cylinder side opening 40*b* of the communication passage 40 and the valve seat around the injection cylinder side opening 40*b* is easily removed to the outside of the communication passage 40. In addition, although illustration is omitted, the disclosure can also be applied even if configured by a backflow prevention device, for example, a rotary valve or the like, which blocks the communication passage 40 in the halfway of the communication passage 40, as long as the melt which includes the various gases inside the injection cylinder 30 can flow back into the melting cylinder 20.

The melting unit 2 is not limited to the embodiment shown in FIG. 1. For example, a bucket-type melting furnace may be employed in place of the melting cylinder 20. A bottom surface of the melting furnace is connected with one end of the communication passage 40. The surrounding of a melting furnace side opening of the communication passage 40 which is formed on the bottom surface of the melting furnace becomes the valve seat 41 of the backflow prevention device 5. Another end of the communication passage 40 is connected to the injection cylinder 30. The unmelted light metal material is put into the melting furnace from above the melting furnace. The melt of the melting furnace may be covered by the inert gas supplied from the inert gas supplying device 6 above the liquid level of the melt. The melting furnace may have a lid for covering the above of the melt. The lid may have an input port for inputting the unmelted light metal material from above into the melting furnace. The inert gas may be filled on an inner side of the lid and above the liquid level of the melt. A volume of the melting furnace may be a sufficient volume in which the melt does not overflow from the melting furnace even if the flowing-back melt is temporarily contained from the injection cylinder 30. In addition, the melting furnace may be horizontally elongated, and the melting furnace side opening of the communication passage 40 may be formed on a bottom surface of a front end side, and an input port through which the unmelted light metal material is input may be formed on a rear end side. In the elongated melting furnace, a division plate which extends from the rear end to the front end and divides the interior of the melting furnace excluding at least the two ends, and the melt may be stirred by a stirring device in a manner that the melt is circulated around the division plate. In addition, the melting furnace may be supplied with the melt which is obtained by melting the light metal material in the outside.

The injection device 1 is not limited to the above-described embodiment. For example, the control device 7 may detect, using the position detector which is included in the injection unit 3 and detects the position to which the plunger 32 is advanced or retracted, the measurement position of the plunger 32 in a state when the communication passage 40 is closed after the melt is measured after the melt flows back, and the control device 7 may detect an advance position of the plunger 32 in a state when the melt inside the injection cylinder 30 is compressed from the measurement position by the predetermined pressure. The various gases are compressed more easily compared with the melt. The control device 7 may calculate a difference between the measurement position and the advance position, then determine, if the difference is greater than a reference value set in advance, that the various gases are not appropriately discharged from the injection cylinder 30 and the various gases remains inside the injection cylinder 30, and stop the injection device. In addition, the control device 7 may store necessary data among the measurement position, the advance position, or a determination result for each molding cycle, and display on a display device in various formats such as numerical values, graphs or lists. The various gases included in the melt are compressed more easily compared with the melt. The amount of the various gases included in the melt is measured according to the advance position of the plunger which is advanced under the predetermined pressure. The various gases included in the melt cause generation of cavities in the molded articles and result in varied weights of the molded articles. The determination method more easily measures and manages data showing the amount of the various gases included in each molded article than measuring the weight of each molded article.

The disclosure can also be applied to, for example, the mold device 8 in which an air vent is connected in the cavity space, and the mold device 8 in which a vacuuming device is connected in the cavity space. In addition, the disclosure can also be applied to the injection device 1 which has the injection nozzle 35, and the injection device 1 in which a front end of the injection cylinder 30 is directly connected to the mold device 8. Particularly, the disclosure can, by using the mold device 8 to which the vacuuming device is connected and the injection device 1 which injects the melt from the injection nozzle 35, easily discharge the various gases in the cavity space of the mold device 8 using the vacuuming device by closing the injection nozzle 35, and further, an effect of suppressing the generation of the cavities inside the molded article 9 can be improved because the various gases inside the injection unit 3 of the injection device 1 can be easily discharged.

The embodiment was chosen in order to explain the principles of the disclosure and its practical application. Many modifications and variations are possible in light of the above teachings. It is intended that the scope of the disclosure be defined by the claims.

What is claimed is:

1. An injection control method of an injection device of light metal injection molding machine, a molding cycle is carried out repeatedly such that a molded article is obtained, in the molding cycle, a melt of a light metal material in a supply unit is supplied into an injection unit through a communication passage, a plunger included in the injection unit is retracted and the melt of a predetermined volume in the injection unit is measured, the communication passage is closed, and the plunger is advanced to inject the melt in the injection unit into a mold device through an injection nozzle included in the injection unit, wherein at a frequency of once for every cycle or every plural cycles in the repeated molding cycles, in the duration after the melt is injected and before the melt is measured, the plunger is advanced under a pressure at which the melt in the injection unit does not come out from the injection nozzle and at least part of the melt in the injection unit is flowed back into the supply unit through the communication passage that is opened.

2. The injection control method of an injection device of light metal injection molding machine according to claim 1, wherein before the melt is flowed back, the plunger is retracted, and the melt is replenished from the supply unit into the injection unit through the communication passage.

3. The injection control method of an injection device of light metal injection molding machine according to claim 2, wherein the melt is replenished in the injection unit exceeding the predetermined volume of the melt during measurement, the melt of the predetermined volume remains in the injection unit, and the melt is flowed back to be measured.

4. The injection control method of an injection device of light metal injection molding machine according to claim 1, wherein after the melt is flowed back, the plunger is retracted, the melt is replenished from the supply unit into the injection unit through the communication passage, and again the melt is flowed back; the above operation is carried out for at least once, and thereafter the melt is measured.

5. The injection control method of an injection device of light metal injection molding machine according to claim 4, wherein the melt is replenished in the injection unit exceeding the predetermined volume of the melt during measurement, the melt of the predetermined volume remains in the injection unit, and the melt is flowed back to be measured.

6. The injection control method of an injection device of light metal injection molding machine according to claim 1, wherein when the communication passage is closed, a valve rod is cooled by a cooling medium flowing inside the valve rod, a semisolid of the melt is generated around the valve rod, the valve rod is seated on a valve seat formed around a supply unit side opening of the communication passage to close the communication passage, and a space between the valve seat and the valve rod seated on the valve seat is sealed by the semisolid; and when the communication passage is opened, the space between the valve seat and the valve rod is opened by being separated at a distance of equal to or less than 20% of an inner diameter of the communication passage, and the semisolid between the valve seat and the valve rod is removed by the melt that is flowed back.

7. The injection control method of an injection device of light metal injection molding machine according to claim 1, wherein a measurement position of the plunger when the predetermined volume is measured is detected, and an advance position of the plunger when the plunger advances from the measurement position under a predetermined pressure is detected.

8. An injection device of light metal injection molding machine, comprising:

a supply unit which supplies a melt of a light metal material;

an injection unit in which a plunger advancing and retracting is disposed and to which an injection nozzle is connected;

a coupling member which couples the supply unit and the injection unit, and in which a communication passage communicating an interior of the supply unit and an interior of the injection unit is formed;

a backflow prevention device which opens and closes the communication passage; and an injection control unit configured to control the supply unit, the injection unit, and the backflow prevention device, and carry out a series of control that: a molding cycle is carried out repeatedly such that a molded article is obtained, in the molding cycle, the melt in the supply unit is supplied into the injection unit through the communication passage, the plunger is retracted to measure the melt of a predetermined volume in the injection unit, the communication passage is closed, and the plunger is advanced to inject the melt in the injection unit into a mold device through the injection nozzle, and carries out a series of control that: at a frequency of once for every cycle or every plural cycles in the repeated molding cycles, in the duration after the melt is injected and before the melt is measured, the plunger is advanced under a pressure at which the melt in the injection unit does not come out from the injection nozzle, and at least part of the melt in the injection unit is flowed back into the supply unit through the communication passage that is opened.

9. The injection device of light metal injection molding machine according to claim 8, wherein the injection control unit carries out a series of control that: before the melt is flowed back, the plunger is retracted, and the melt is replenished from the supply unit into the injection unit through the communication passage.

10. The injection device of light metal injection molding machine according to claim 9, wherein the injection control unit carries out a series of control that: the melt is replenished in the injection unit exceeding the predetermined volume of the melt during measurement, the melt of the predetermined volume remains in the injection unit, and the melt is flowed back to be measured.

11. The injection device of light metal injection molding machine according to claim 8, wherein the injection control unit carries out a series of control that: after the melt flows back, the plunger is retracted, the melt is replenished from the supply unit into the injection unit through the communication passage, and again the melt is flowed back, which is carried out for at least once, and thereafter the melt is measured.

12. The injection device of light metal injection molding machine according to claim 11, wherein the injection control unit carries out a series of control that: the melt is replenished in the injection unit exceeding the predetermined volume of the melt during measurement, the melt of the predetermined volume remains in the injection unit, and the melt is flowed back to be measured.

13. The injection device of light metal injection molding machine according to claim 8, wherein the backflow prevention device comprises a valve seat formed around on a supply unit side opening of the communication passage, a valve rod which is seated on the valve seat to close the communication passage and opens the communication passage by being separated from the valve seat, a valve rod driving device which drives the valve rod, and a cooling piping which is arranged inside the valve rod and through which a cooling medium flows;

the injection control unit carries out a series of control that: when the communication passage is closed, the valve rod is cooled by the cooling medium flowing through the cooling piping, a semisolid of the melt is generated around the valve rod, the valve rod is seated on the valve seat to close the communication passage, and a space between the valve seat and the valve rod seated on the valve seat is sealed by the semisolid; and when the communication passage is opened, the space between the valve seat and the valve rod is opened by being separated at a distance of equal to or less than 20% of an inner diameter of the communication passage, and the semisolid between the valve seat and the valve rod is removed by the melt that is flowed back.

14. The injection device of light metal injection molding machine according to claim 8, wherein the injection unit comprises a position detector which detects a measurement position of the plunger when the predetermined volume is measured, and an advance position of the plunger when the plunger advances from the measurement position under a predetermined pressure.

15. The injection device of light metal injection molding machine according to claim 8, wherein the supply unit is a melting unit which melts an unmelted light metal material supplied from outside into a melt inside the supply unit and supplies the melt to the injection unit through the communication passage.

16. The injection device of light metal injection molding machine according to claim 15, wherein the melting unit comprises a melting cylinder which melts the unmelted light metal material supplied from outside into the melt inside the melting cylinder and supplies the melt to the injection unit through the communication passage, and an inert gas storage portion which is connected to the melting cylinder to accommodate an excessive melt in the melting cylinder and provides an inert gas atmosphere above the accommodated melt.

17. The injection device of light metal injection molding machine according to claim 15, wherein the melting unit comprises a melting furnace which is horizontally elongated and in which the communication passage is connected to a front end side and the unmelted light metal material is supplied to a rear end side, a division plate which extends from a rear end to a front end of the melting furnace and divides an interior of the melting furnace excluding at least both ends on the front end side and the rear end side, and a stirring device which stirs the melt in a manner that the melt circulates around the division plate.

18. The injection device of light metal injection molding machine according to claim 8, wherein the supply unit supplies the melt supplied from outside to the injection unit.

* * * * *